United States Patent [19]

King et al.

[11] 4,066,723

[45] Jan. 3, 1978

[54] METHOD AND APPARATUS FOR MAKING FIBROUS CONCRETE

[75] Inventors: Ralph J. King, Dunlap; William H. Belke, Peoria; William E. Dearlove, Washington, all of Ill.

[73] Assignee: Caterpillar Tractor Co., Peoria, Ill.

[21] Appl. No.: 668,352

[22] Filed: Mar. 19, 1976

[51] Int. Cl.[2] ..... E01C 11/18

[52] U.S. Cl. ..... 264/34; 264/176 R; 264/256; 404/70; 404/72; 404/82; 404/100; 404/108

[58] Field of Search ..... 264/34, 256, 70, 174, 264/251, 176 R; 404/82, 101, 108, 70, 72, 100; 52/659; 106/99

[56] References Cited

U.S. PATENT DOCUMENTS

| | | | |
|---|---|---|---|
| 3,289,371 | 12/1966 | Pearson | 264/309 X |
| 3,429,094 | 2/1969 | Romualdi | 52/659 X |
| 3,950,465 | 4/1976 | Farahar | 264/256 X |

*Primary Examiner*—Thomas P. Pavelko

*Attorney, Agent, or Firm*—Wegner, Stellman, McCord, Wiles & Wood

[57] ABSTRACT

A method of producing a fiber reinforced concrete structure of desired thickness including the steps of extruding a sheet of concrete substantially free of fibers, distributing an effective amount of reinforcing fibers on the sheet, repeating the foregoing steps until the desired thickness is approached and before the concrete sheets have set up, and extruding a further sheet of substantially fiber-free concrete over the structure resulting from the foregoing steps to achieve the desired thickness. The amount of fiber distributed over each sheet may be varied to concentrate the fiber in the areas where the greatest stress concentration is expected. Also disclosed is an apparatus for performing the method.

5 Claims, 3 Drawing Figures

METHOD AND APPARATUS FOR MAKING FIBROUS CONCRETE

BACKGROUND OF THE INVENTION

This invention relates to concrete and, more particularly, to fibrous concrete.

Prior art of possible relevance includes U.S. Pat. No. 3,808,085 to Givens, issued Apr. 30, 1974.

Recent years have seen an upsurge in the use of fiber reinforced concrete. Structures formed of fiber reinforced concrete have superior strength over unreinforced concrete and, in many instances, can be employed in lieu of concrete reinforced with reinforcing rods or bars (rebars) to provide similar strength at lesser cost.

Various fibers have been employed. Most often, steel fibers are used, but in many instances, ceramic fibers, such as glass fibers, have been employed. Typically, the fibers are dispersed randomly within the mix and the structure resulting from a pour of the mix. As a consequence, the maximum reinforcement provided by a given number of fibers cannot be achieved. Those fibers parallel to the direction of a bending force application to the concrete structure provide no reinforcing whatsoever, while those fibers only slightly angled with respect to the direction of the bending force application provide but minimal reinforcement. Consequently, it has been necessary to incorporate in such concrete, a far greater number of fibers than actually necessary to ensure that proper reinforcing will be achieved with such a random distribution.

This, in turn, has posed not only an economical problem due to the cost of the increased amount of fibers, but a labor problem as well. When used in the large amounts required, the fibers have a tendency to adhere to each other or "ball." When balls are left in the poured concrete, a weak spot is formed. Moreover, the presence of such balls impedes finishing operations. Accordingly, it has been necessary to manually retrieve the fiber balls from the concrete as it is being poured and finished.

SUMMARY OF THE INVENTION

It is the principal object of the invention to provide a new and improved fibrous concrete. More specifically, it is an object to provide a method of forming a fibrous concrete structure and an apparatus for performing the method.

The inventive method achieving the foregoing objects, in its broadest sense, includes the step of forming a sheet of concrete, distributing reinforcing fiber on the sheet, and applying a further sheet of concrete to the sheet and the fibers distributed thereon before the first sheet has set. As a consequence, the fibers will have a substantially two-dimensional orientation so as to all be substantially transverse to the direction of force application to the resulting panel. Consequently, all fibers are load bearing with the result that the number of fibers employed may be minimized over prior art methods.

According to a preferred embodiment of the invention, the foregoing steps are repeated until a desired thickness of the resulting structure is approached. A final cover sheet of concrete is then applied.

The amount of fibers deposited on each sheet may be varied in accordance with expected stress characteristics. In some cases, the number of fibers deposited on each sheet will be increased as the method is performed, while in other cases, the opposite will be true. In most cases, during the fabrication of the structure, the number of fibers deposited on each sheet will be progressively decreased until approximately half of the desired thickness of the structure is attained, at which time a progressive increase of the number of fibers deposited on each sheet will be initiated.

An apparatus made according to the invention comprises a plurality of aligned, spaced concrete extruding orifices and means for supplying a concrete mix to the orifices. A plurality of reinforcing fiber dispensing devices are provided with one dispensing device located between each of the orifices. A support for the orifices supplying means and dispensing devices is provided.

According to a preferred embodiment, the supporting means comprises a vehicle frame so that the apparatus can be employed for paving. In a highly preferred embodiment, the supplying means comprises a hopper and orifices are spaced along the bottom of the hopper.

Other objects and advantages will become apparent from the following specification taken in connection with the accompanying drawings.

DESCRIPTION OF THE DRAWINGS

FIG. 3 is a stress diagram illustrating the distribution of stress in a concrete slab or the like.

DESCRIPTION OF THE PREFERRED EMBODIMENT

The inventive method includes the steps of (a) extruding a sheet of concrete substantially free of fibers so as to enhance handling characteristics; (b) depositing reinforcing fibers on the sheet formed by step (a); and (c) extruding a further sheet of concrete substantially free of reinforcing fibers on the first sheet and on the fibers distributed thereon before the first sheet has set up.

Because the fibers are distributed upon the first sheet of concrete, they will tend to assume the configuration of the upper surface of such a sheet, normally planar. Thus, substantially all of the fibers will lie in a plane generally transverse to the application of a bending force (i.e., parallel to induced stresses) to the structure resulting from the performance of the method. Consequently, all fibers will be load bearing. It has been determined that the number of fibers employed to achieve a given reinforcement in concrete may be reduced 50% through use of the method over the prior art method wherein the fibers are randomly distributed throughout the structure.

In many cases, such as in the construction of an overlay for a road or the like, steps (a) and (b) will be serially repeated until the desired thickness of the overlay is approached. Thereafter, a final sheet of concrete is extruded on the topmost sheet and the fibers distributed thereon.

The invention also contemplates that the number of fibers distributed on each sheet may be varied throughout the resulting concrete structure.

Where the force to which the structure is to be subjected is applied to the last formed sheet in a direction substantially transverse to its surface and compressive stresses only are of concern, as the structure is fabricated according to the foregoing method, the number of fibers deposited on each sheet is progressively decreased throughout the fabrication operation.

For the same situation where only tensional stresses are of concern, the number of fibers deposited on each sheet during the fabrication operation is progressively increased.

Figure 3:
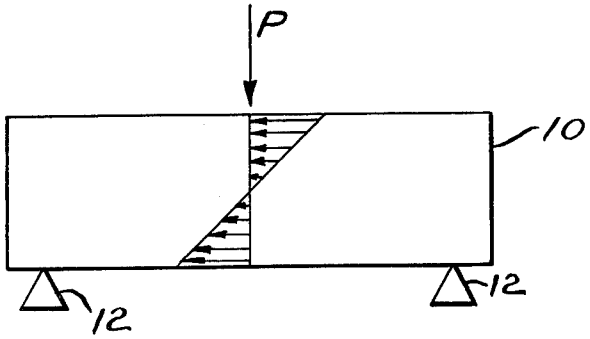

In most instances, both compression and tension forces are of concern, as can be seen by reference to FIG. 3. FIG. 3 illustrates a concrete structure 10 having a force P applied to the upper surface thereof in a direction substantially transverse to the upper surface. The concrete structure 10 is supported at spaced points 12.

From the top to the bottom of the structure, compressive stresses are the greatest at the top and are approximately zero at the middle of the structure. Tensional stresses begin to appear at the midpoint of the structure and increase to the bottom thereof. Thus, to provide reinforcement stresses, as the structure is formed, initially, the number of fibers deposited on each sheet will be progressively decreased until approximately half the desired thickness is achieved. At this time, the number of fibers deposited on each sheet will be progressively increased.

It is contemplated that no fibers need be deposited in the immediate vicinity of the midpoint of the structure as the tensional and compressive stresses at such a point are zero or minimal, as illustrated in FIG. 3.

Figure 1:
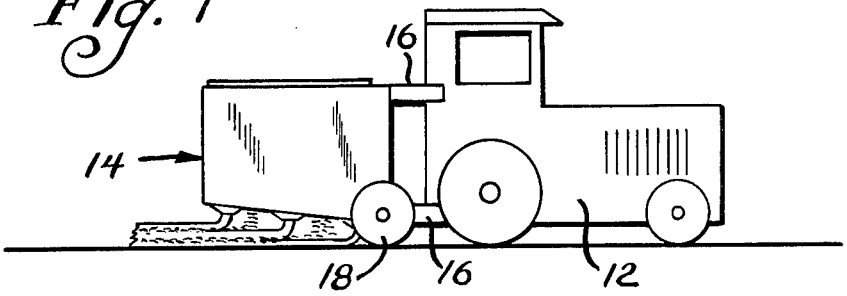
FIG. 1 is a side elevation of an apparatus made according to the invention.
Figure 2:
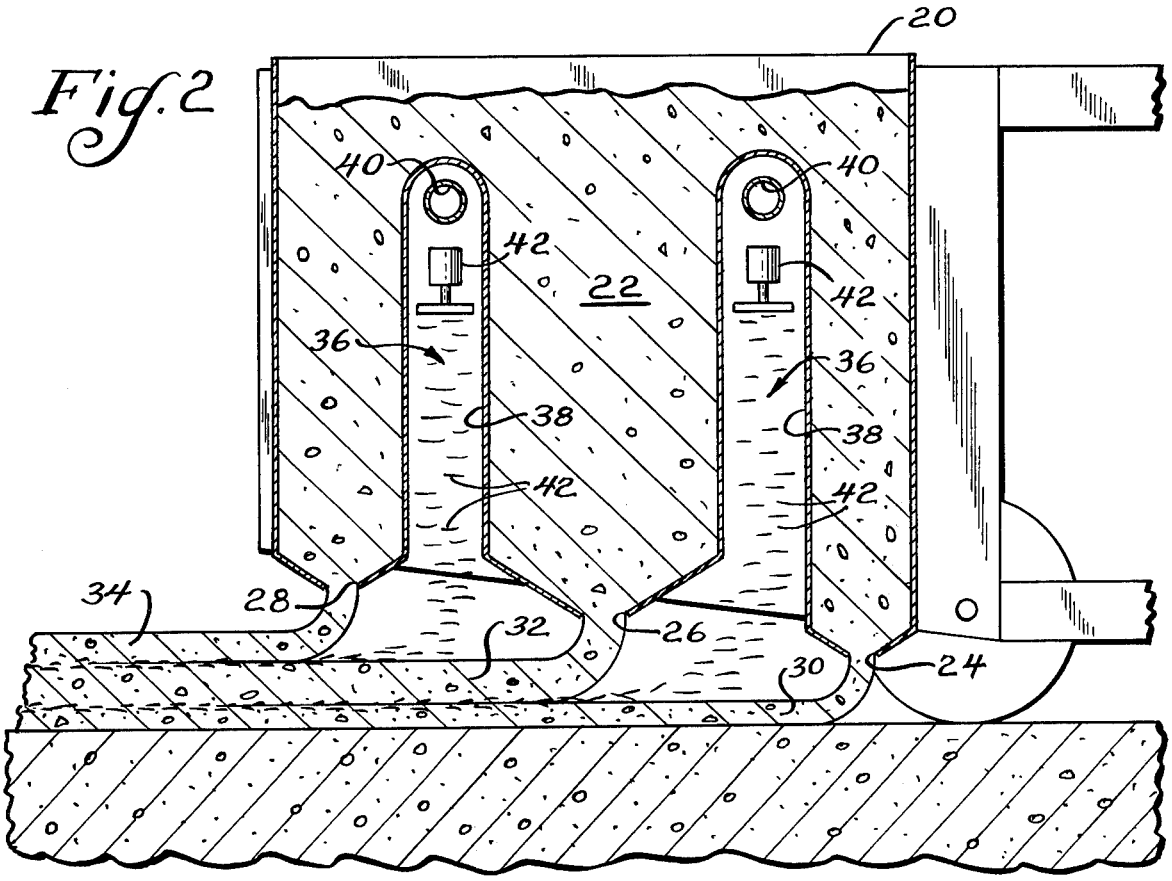
FIG. 2 is an enlarged, fragmentary, vertical section of the apparatus.

FIGS. 1 and 2 illustrate one form of an apparatus for practicing the inventive method in connection with the depositing of an overlay on highways or the like. A motorized vehicle 12 mounts the inventive apparatus, generally designated 14, for movement through the construction zone by means of frame members 16. The apparatus 14 may be wholly supported by the vehicle 12 or may be supported by wheels 18 or the like.

The apparatus 14 includes an upwardly open hopper 20 for receipt of a substantially fiber-free concrete mix 22. The underside of the hopper 20 is provided with a plurality of elongated concrete extruding orifices 24, 26 and 28 through which the concrete 22 is extruded in the form of sheets 30, 32 and 34. As can be seen in FIG. 2, the orifices 24, 26 and 28 are spaced and aligned so that the sheets 30, 32 and 34 are separately deposited in superimposed relation.

Between the orifices 24 and 26 and 28 are fiber dispensing devices, generally designated 36. Each is defined by a downwardly open, U-shaped housing 38 formed within the hopper 20 and opening between the adjacent orifices. At the upper end of each housing 38 is an opening 40 into which, by any suitable means, the reinforcing fibers to be dispensed may be introduced. Below each opening 40 and within the housing 38 is a motor driven beater 42 which is operative to distribute descending fibers 42 across the housing 38 and to break up any fiber balls introduced into the housing 38.

It will be noted that the apparatus illustrated in FIG. 2 is provided with a large central orifice 26 flanked by two smaller orifices 24 and 28. Thus, the center of the resulting structure will not be provided with fibers to take advantage of the fact that stresses at the center of the structure are zero or minimal. Consequently, the apparatus provides for minimizing the number of fibers required.

It will be understood that frequently a far greater number of extruding orifices than that illustrated in FIG. 2 will be employed. For example, it is contemplated that eight extrusion orifices would be employed in an apparatus for fabricating a four-inch overlay.

In general, it is desirable that the sheets 30, 32 and 34 be relatively thin, preferably on the order of $\frac{3}{8}$ to $\frac{1}{2}$ inch. In actuality, minimum thickness is governed by the size of the aggregate employed in the concrete mix 22, it being necessary that the extrusion openings 24, 26 and 28 be sufficiently wide so that the largest aggregate may be extruded without hanging up within the orifice.

Sizable reductions in the quantity of fibers required to provide so-called "crack control" can be obtained where the fibers are oriented substantially parallel to the tensile stresses. For example, in roads, runways, or the like, adequate crack control can be obtained by orienting the fibers to be substantially parallel to the length of the structure employing only about 41% of the fibers required to achieve the same degree of crack control if randomly oriented.

Romualdi and Mandel[1] have established that the average spacing of the centroids of the wires equals:

$$S = \sqrt{V/0.41NL} \qquad 1$$

where:

$N$ = the total number of fibers per cubic yard,
$L$ = the length of the fibers, and
$V$ = the volume of the concrete reinforced by the fibers.

[1] Journal of the American Concrete Institute, June 1964, pages 657 et seq.

By substitution, Romualdi and Mandel have also established that:

$$S = 13.8d\sqrt{1/P_r} \qquad 2$$

where:

$d$ is the diameter of the steel fibers, and
$P_r$ is the percentage of steel fiber volume to total volume, or steel fiber volume divided by the number of cubic yards $\times$ 100 in random orientation.

Using the same mathematical process as Romualdi and Mandel, it can be established that the average spacing, if all fibers were oriented in the direction of the tensile stresses would be equal to:

$$S = 8.86d\sqrt{1/P_c} \qquad 3$$

where:

$P_c$ = percentage of steel fiber volume to total volume in controlled orientation.

To achieve the same strength level with random fiber orientation that can be obtained with controlled orientation, almost $2\frac{1}{2}$ times more fiber is required, as shown by the following:

$$P_r/P_c = 13.8^2/8.86^2 = 191/78.5 = 2.43 \qquad 4$$

Thus, not only can the amount of fiber and, thus, balling problems, be minimized by layering the fibers in the concrete mass as disclosed, but a further reduction can be achieved by orienting the fibers to be substantially parallel to the direction of tensile stress.

It can also be established that in structural stress situations, through the orienting of the fibers substantially parallel to the stress, only about 10% of the fiber required to achieve a given strength through random distribution need be employed.

From the foregoing, it will be appreciated that the invention provides for improved fibrous concrete in that it eliminates the possibilities of balling and minimizes the number of fibers required to thereby provide an economical and trouble free method and apparatus for forming such concrete.

We claim:

1. A method of producing a sheet-like, fiber reinforced concrete structure of a desired thickness comprising the steps of:

a. extruding a sheet of concrete substantially free of reinforcing fibers on a support;

b. thereafter distributing from above the sheet an effective amount of staple reinforcing fibers on the surface of the sheet remote from the support resulting from step (a) before the sheet has set up such that the fibers lie essentially in the plane of said surface;

c. extruding a further sheet of concrete substantially free of reinforcing fibers on said surface of the sheet and the reinforcing fibers received thereon before the concrete sheet has set up;

d. repeating steps (b) and (c) until the desired thickness of the sheet-like structure is approached and before the concrete sheet(s) has set up;

e. extruding a further sheet of substantially fiber-free concrete over the structure resulting from step (d) before the concrete sheets have set up to achieve said desired thickness; and f. varying the amount of staple fibers distributed during each performance of step (b) to obtain a predetermined fiber distribution from sheet to sheet.

2. The method of claim 1 wherein step (f) is performed by increasing the number of fibers distributed for each performance of step (b).

3. The method of claim 1 wherein step (f) is performed by decreasing the number of fibers distributed for each performance of step (b).

4. The method of claim 1 wherein step (f) is performed by the steps of first decreasing the number of fibers distributed for each performance of step (b) and then increasing the number of fibers distributed for each performance of step (b).

5. The method of claim 4 wherein the step of decreasing is terminated and the step of increasing is initiated approximately when one-half of the desired thickness is attained.

* * * * *